US005713310A

United States Patent [19]

Lemke

[11] Patent Number: 5,713,310

[45] Date of Patent: Feb. 3, 1998

[54] HEAT EXCHANGER FOR PRESSURE WASHER

[75] Inventor: Alfred H. Lemke, Siloam Springs, Ark.

[73] Assignee: Clarke Industries, Inc., Springdale, Ark.

[21] Appl. No.: 635,459

[22] Filed: Apr. 22, 1996

[51] Int. Cl.[6] ..... F22B 37/10

[52] U.S. Cl. ..... 122/248; 122/18; 122/19

[58] Field of Search ..... 122/18, 19, 248, 122/250 R, 267.3

[56] References Cited

U.S. PATENT DOCUMENTS

| | | | |
|---|---|---|---|
| 200,482 | 2/1878 | Salisbury . | |
| 548,941 | 10/1895 | Wilder . | |
| 1,883,733 | 10/1932 | Hahn . | |
| 1,983,170 | 12/1934 | Hanna | 122/19 |
| 2,183,893 | 12/1939 | Price | 122/250 |
| 2,223,856 | 12/1940 | Price | 122/451 |
| 2,232,935 | 2/1941 | Bailey | 122/328 |
| 2,276,529 | 3/1942 | Throckmorton et al. | 122/356 |
| 2,633,108 | 3/1953 | Sterick | 122/250 |
| 3,130,779 | 4/1964 | Huet | 165/146 |
| 3,529,579 | 9/1970 | Wanson | 122/248 |
| 3,677,338 | 7/1972 | Staub | 165/111 |
| 4,338,888 | 7/1982 | Gerstmann et al. | 122/16 |
| 4,357,910 | 11/1982 | Blockley et al. | 122/248 |
| 4,444,155 | 4/1984 | Charron et al. | 122/19 |
| 4,453,498 | 6/1984 | Juhász | 122/136 |
| 4,473,034 | 9/1984 | Raudabaugh et al. | 122/18 |
| 4,499,859 | 2/1985 | Nishiguchi et al. | 122/18 |
| 4,617,820 | 10/1986 | Hammond | 73/1 |
| 4,679,528 | 7/1987 | Krans et al. | 122/367 C |
| 4,723,513 | 2/1988 | Vallett et al. | 122/19 |
| 4,793,800 | 12/1988 | Vallett et al. | 431/328 |
| 4,901,677 | 2/1990 | Demetri | 122/235 F |
| 4,981,112 | 1/1991 | Adams et al. | 122/19 |
| 5,086,831 | 2/1992 | Paikert et al. | 165/47 |
| 5,365,888 | 11/1994 | Aronov | 122/19 |

OTHER PUBLICATIONS

McGraw-Edison, Clarke® Instruction Book and Parts List "Model Laser™ 700H Pressure Washer", 1985, pp. 18–19.

Clarke® Delco™, Springdale, Arkansas "Clarke® Delco™ Equalizer Owner's Manual Models 210BD, 385 BD, 420 IBD & 315 BD" 1990,pp. 10–11.

Clarke® Delco™, Springdale, Arkansas "Versa 4200 Series" Advertising Brochure, Oct. 1990.

Clarke® Delco™, Springdale, Arkansas "Versa 100 Series" Advertising Brochure, Feb. 1993.

Clarke® Delco, Springdale, Arkansas "Versa 4300E/5200E" Advertising Brochure, Nov. 1993.

*Primary Examiner*—Henry A. Bennett
*Assistant Examiner*—Gregory A. Wilson
*Attorney, Agent, or Firm*—Senniger, Powers Leavitt & Roedel

[57] ABSTRACT

A high pressure washer of this invention comprises a heat exchanger for heating a cleaning fluid, and a dispenser for dispensing heated cleaning fluid under pressure onto a surface to clean it. The heat exchanger comprises a tubular casing and a generally coaxial tubular heat shield inside the casing defining a combustion chamber. A burner is mounted adjacent a first end wall of the casing for discharging flames and hot combustion gases into the combustion chamber. A heating coil inside the casing extends longitudinally with respect to the casing for containing cleaning fluid to be heated. The heating coil comprises a length of unfinned tubing disposed in a gap between the heat shield and a second end wall of the casing, and a length of finned tubing in the annular space between the heat shield and the casing. The burner is operable to emit flame and hot gases of combustion into said combustion chamber in a direction toward the second end wall of the casing. The heat shield serves to protect the finned tubing by directing the hot gases of combustion for contact first with said unfinned tubing, resulting in cooling of the gases, followed by contact with the finned tubing in said annular space, thereby enhancing the heat transfer between the gases and the fluid contained within the heating coil.

20 Claims, 3 Drawing Sheets

HEAT EXCHANGER FOR PRESSURE WASHER

BACKGROUND OF THE INVENTION

This invention relates generally to a high pressure washer used for heating a pressurized cleaning liquid and jetting the liquid onto a surface to clean it, and more particularly to such a washer having an improved, more efficient heat exchanger.

In pressure washers of conventional design, a burner introduces hot gaseous products of combustion into a combustion chamber surrounded by a heating coil containing a liquid cleaning solution under pressure (e.g., up to 4,000 psi or greater). The solution is heated as it flows through the coil, which is typically of unfinned tubing. (The temperatures generated in the combustion chamber have been too high to permit the use of finned tubing.) After being heated to a suitable temperature (e.g., 250 degrees F.), the solution is dispensed by means of a sprayer, for example, onto a surface to be cleaned. Pressure washers of this type have been made by various companies, including Clarke Industries, Inc. which sells such washers under the trademark DELCO™.

The heat exchanger design used in conventional pressure washers and described above is not as efficient as desired, resulting in wasted energy, lower than desired cleaning solution temperatures, and excessive exhaust stack temperatures. Moreover, the relatively low cleaning solution temperatures may create a "cold" combustion chamber preventing the complete combustion of fuels introduced into the system.

SUMMARY OF THE INVENTION

Among the several objects of this invention may be noted the provision of a pressure washer with an improved heat exchanger with more efficient heat transfer characteristics; the provision of such a heat exchanger which results in more efficient combustion of fuel introduced into the combustion chamber; the provision of such a heat exchanger which can be used with multiple types of fuel, such as diesel fuel, propane gas, natural gas and other fuels; the provision of such a heat exchanger which is lightweight and easy to construct; and the provision of such a heat exchanger which is capable of heating more cleaning liquid with less fuel consumption.

Briefly, a high pressure washer of this invention comprises a heat exchanger for heating a cleaning fluid, and a dispenser for dispensing heated cleaning fluid under pressure onto a surface to clean it. The heat exchanger comprises a casing having first and second end walls and a tubular sidewall extending therebetween along a central longitudinal axis, and a tubular heat shield inside the casing having a first end adjacent the first end wall of the casing and a second end spaced from the second end wall of the casing to define a gap therebetween. The heat shield has an inner surface defining a combustion chamber within the casing, and an outer surface. A burner is mounted adjacent the first end wall of the casing for discharging flames and hot combustion gases into the combustion chamber. An annular space is provided between the outer surface of the heat shield and the casing. A heating coil inside the casing extends longitudinally with respect to the casing for containing cleaning fluid to be heated. The heating coil comprises a length of unfinned tubing disposed in the gap between the second end of the heat shield and the second end wall of the casing, and a length of finned tubing in the annular space between the heat shield and the casing. The burner is operable to emit flame and hot gases of combustion into said combustion chamber in a direction toward said second end wall. The heat shield serves to protect the finned tubing by directing the hot gases of combustion for contact first with said unfinned tubing, resulting in cooling of the gases, followed by contact with the finned tubing in said annular space, thereby enhancing the heat transfer between the gases and the fluid contained within the heating coil.

Other objects and features will become in part apparent and in part pointed out hereinafter.

BRIEF DESCRIPTION OF THE DRAWINGS

Corresponding parts are designated by corresponding reference characters and numerals throughout the several views of the drawings.

DESCRIPTION OF THE PREFERRED EMBODIMENT

Figure 1:
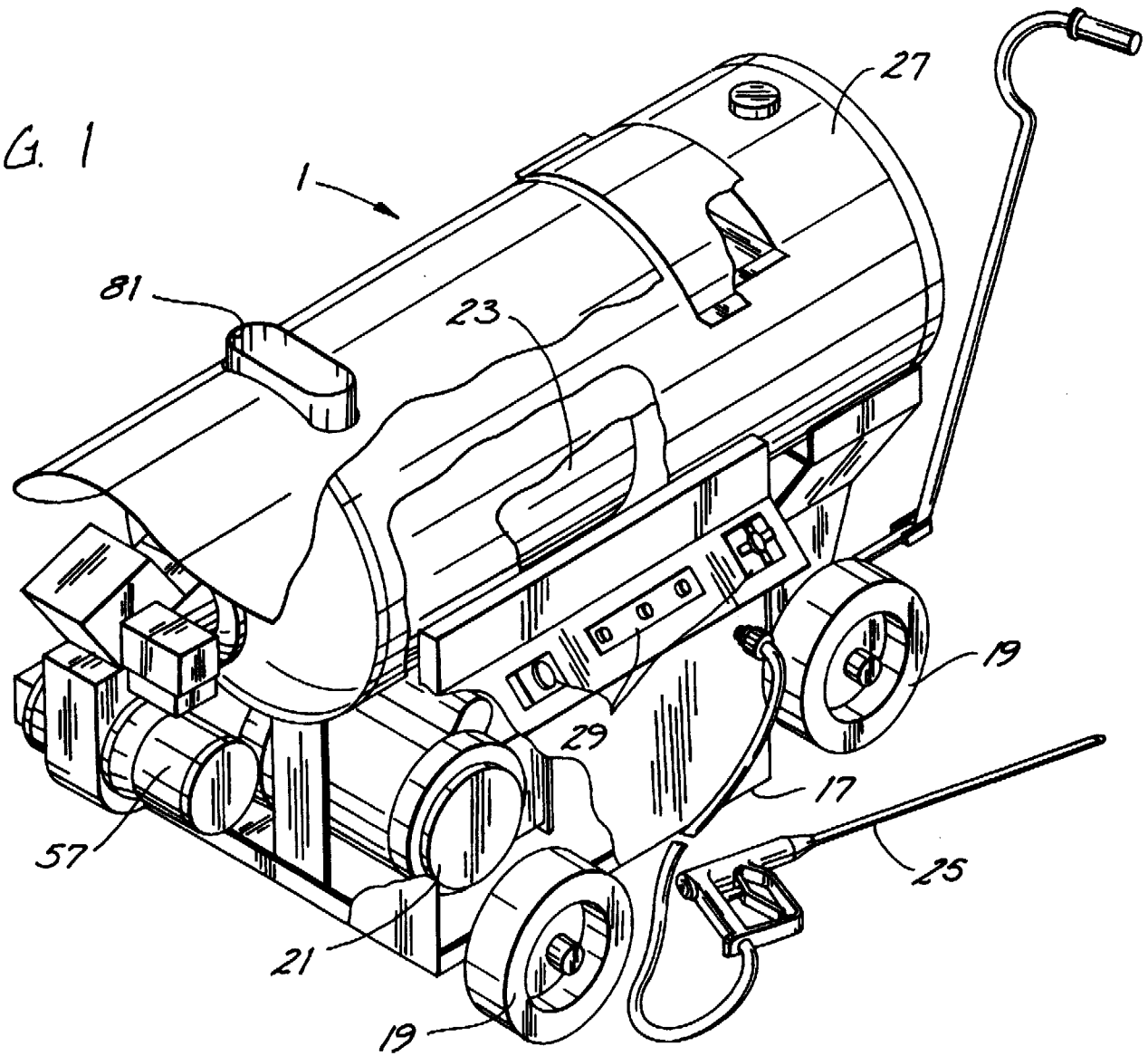
FIG. 1 is a view of a pressure washer of this invention with parts removed to show details.

Referring now to FIG. 1, a pressure washer of the present invention is indicated in its entirety by the reference numeral 1. The washer comprises a frame 17 on wheels 19 carrying a motor 21 which drives a pump (not shown) for pressurizing a cleaning liquid (e.g., water mixed with a suitable detergent, degreasing agent, etc.), a heat exchanger, generally designated 23, for heating the pressurized solution, and a dispenser or applicator in the form of a spray wand 25 for dispensing the high pressure heated solution onto a surface to clean it. The pump and heat exchanger 23 and other components of the pressure washer are enclosed by a housing 27 on the frame 17. Suitable controls 29 on the housing 27 are provided for activating the pump, adjusting the mixture of chemicals in the cleaning solution and controlling the operation of the heat exchanger 23.

Figure 2:
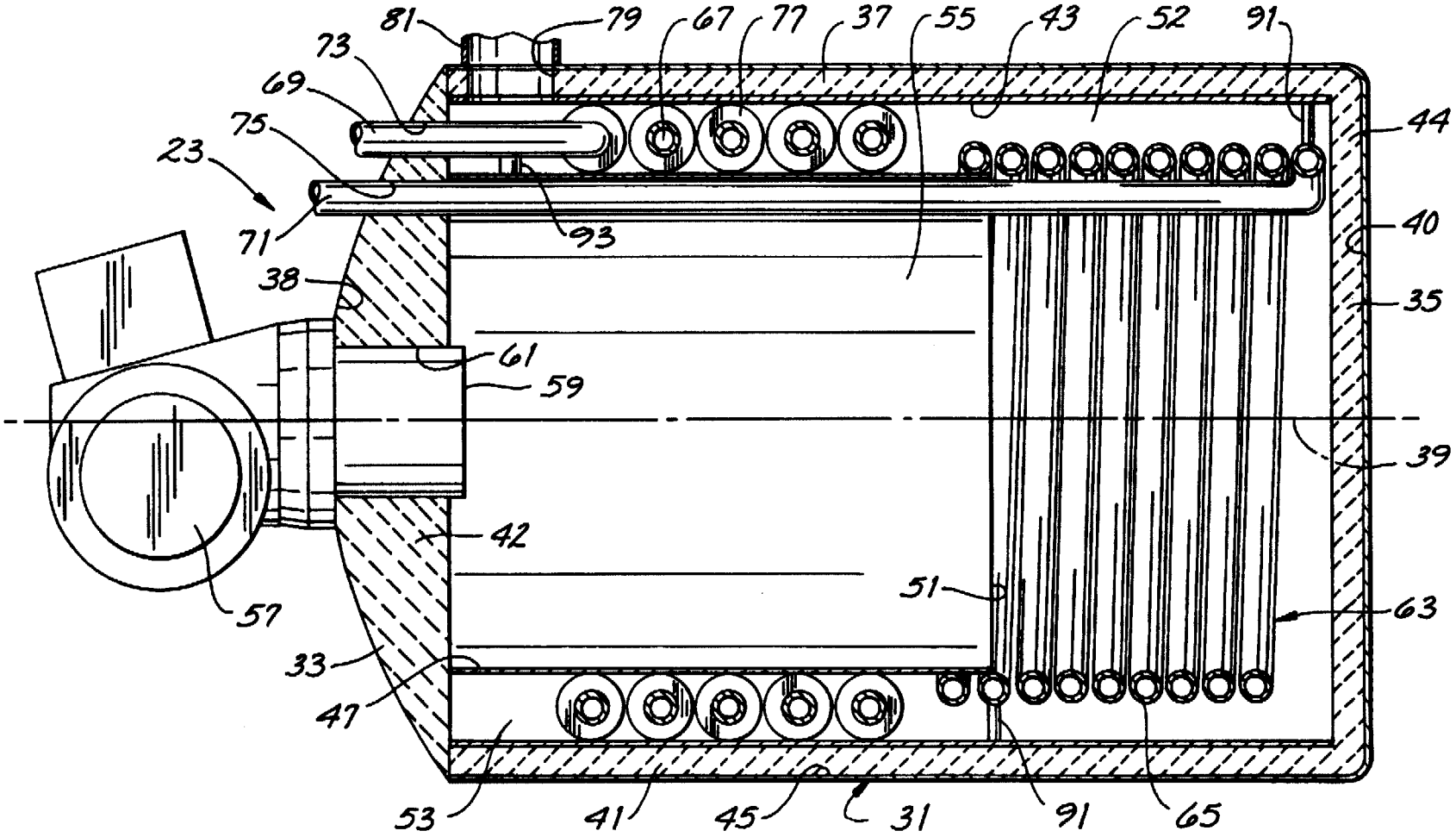
FIG. 2 is a sectional view showing a heat exchanger of the pressure washer, the section being taken longitudinally with respect to the exchanger.
Figure 3:
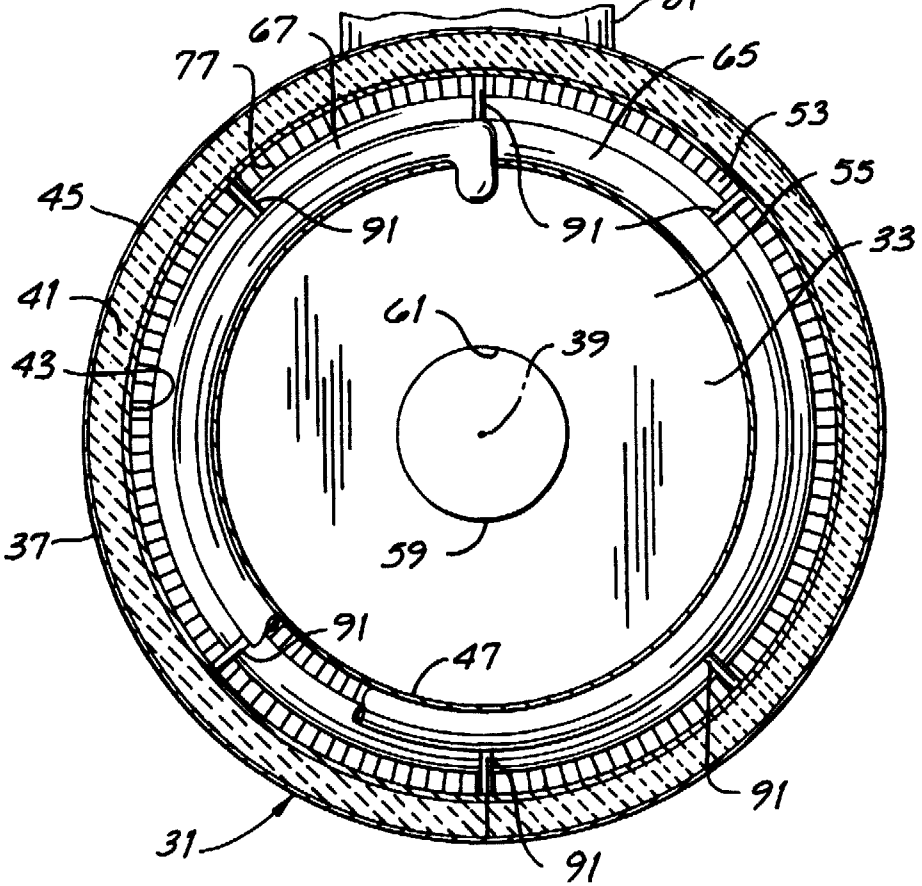
FIG. 3 is a sectional view of the heat exchanger of FIG. 2 taken transversely with respect to the exchanger.

FIGS. 2 and 3 illustrate the construction of the heat exchanger 23. The heat exchanger 23 comprises a casing, shown generally at 31, having first (left in FIG. 2) and second (right) end walls designated 33 and 35, respectively, and a tubular (e.g., cylindric) side wall 37 extending between the end walls. The casing 31 has a central longitudinal axis indicated at 39. The left end wall 33 is in the form of a steel dome which is suitably secured (e.g., welded or fastened) to the side wall 37. Alternatively, the left end wall 33 may also be in the form of a steel dish or plate and remain within the scope of this invention. The right end wall 35 comprises a steel dish or plate which is secured, as by welding or fasteners, to the side wall 37. At least one of the end walls 33, 35 should be removable to enable replacement of certain components of the heat exchanger 23. Each of the end walls 33, 35 comprises an outer steel wrapper, labeled 38 and 40, respectively, formed from 16 ga. carbon steel or other suitable material and an inner lining of refractory 42, 44 (e.g. a one-inch thick layer of ceramic). As shown in FIG. 3, the side wall 37 comprises a layer of insulation 41 (e.g., a one-inch thick layer of woven ceramic) sandwiched between inner 43 and outer 45 steel wrappers formed from 16 ga. carbon steel plate or other suitable material. The spacing between the two wrappers 43, 45 may be maintained by suitable spacers (not shown) between the wrappers. An outer coating of paint or the like may be applied to the side 37 and end 33, 35 walls of the casing 31 for enhancing protection and appearance.

A tubular (e.g., cylindric) heat shield 47 is disposed inside the casing 31 generally coaxial with the casing. The heat shield 47, formed from a suitable material such as 16 ga. stainless steel plate, has a first (left) end 49 abutting the refractory lining 42 of the left end wall 33 of the casing 31 and a second (right) end 51 spaced from the right end wall 35 of the casing to define a gap 52 therebetween. The outside diameter of the heat shield 47 is less than the diameter of the inner steel wrapper 43 of the side wall 37 of the casing 31, so that an annular space 53 is formed between the outer surface of the heat shield and the inner surface of the casing side wall.

The inner surface of the heat shield 47 defines a combustion chamber 55 for the combustion of fuel and hot gases expelled by a burner 57 mounted on the frame 17 of the pressure washer 1 adjacent the left end wall 33 of the casing 31 (see FIG. 2). The burner 57 has an outlet 59 extending through an opening 61 in the left end wall 33 of the casing 31. A suitable seal (not shown) is provided between the burner outlet 59 and the casing 31. The burner 57 is operable to mix fuel (e.g., diesel fuel, propane, natural gas or other fuel) and air to form a combustible mixture which is then ignited and discharged into the combustion chamber 55 of the casing 31 for combustion. The burner 57 may be of conventional design, such as a burner made by Wayne Home Equipment of Fort Wayne, Ind., model M-SR, model EH-SR or model EHA-SR. The burner 57 and heat shield 47 should be sized to ensure that the flame from the burner does not contact or impinge upon the heat shield, which can result in incomplete combustion, the formation of soot, and/or quenching of combustion altogether.

Referring again to FIG. 2, a heating coil, generally designated 63, is disposed inside the casing 31 and extends longitudinally and generally coaxially with respect to the casing. The coil 63 contains cleaning fluid to be heated. The coil 63 comprises a length of unfinned tubing 65 constituted by a first plurality of winds disposed in the gap 52 between the right end 51 of the heat shield 47 and the right end wall 35 of the casing 31, and a length of finned tubing 67 constituted by a second plurality of winds disposed in the annular space 53 between the heat shield and the casing. The first wind of unfinned tubing 65 proximate the heat shield 47 wraps around the outer surface of the heat shield and is secured (e.g. by welding or fasteners) thereto to hold the heat shield in place. Wind connectors 91 are secured by welding or fasteners between the winds of unfinned tubing 65 and the inner steel wrapper 43 of the side wall 37 of the casing 31.

The heating coil 63 has an inlet line 69 connected to the finned tubing 67 for flow of cleaning fluid into the finned tubing and an outlet line 71 connected to the unfinned tubing 65 for flow of heated cleaning fluid out of the unfinned tubing for delivery to the aforementioned dispenser 25. As shown in FIG. 2, the inlet 69 and outlet 71 lines pass through openings 73, 75 in the left end wall 33 of the casing 31. At least one heat shield connector 93 is secured by welding or fasteners between the inlet line 69 and the outer surface of the heat shield 47 to further hold the heat shield in place. The outlet line 71 is routed through the combustion chamber 55 close to the heat shield 47 before exiting the casing 31.

The winds of unfinned tubing 65 located in gap 52 are spaced apart a suitable distance (e.g., 0.125 in.) to permit sufficient flow of hot combustion gases therebetween for maximum heat transfer to the liquid inside the tubing. The spacing between the winds of unfinned tubing 65 may vary depending on the static pressures generated by the fan in the burner 57. (Higher static pressures will result in the required gas flow through narrower spacing between the winds of unfinned tubing 65, while lower static pressures will require wider spacing to provide the desired flow.) The transfer of heat from the gas to the unfinned tubing 65 causes the temperature of the gas to drop to a level which will not damage fins 77 spaced at intervals along the finned tubing 67 (e.g., from 2300 degrees F. to 1100 degrees F.). The unfinned tubing 65 can be formed from any suitable heat transfer material (e.g., 1010 carbon steel) so long as the tubing is capable of withstanding the high temperatures in the combustion chamber 55, which may range from about 1800 degrees F.–about 2800 degrees F. or greater.

Figure 4:
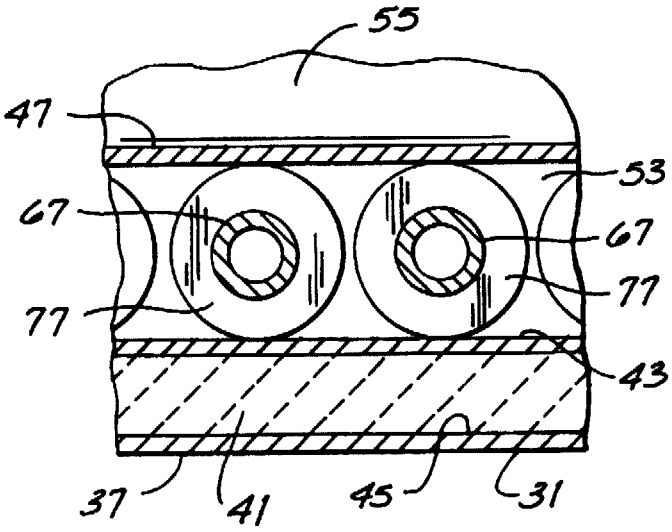
FIG. 4 is an enlarged view of a portion of FIG. 2 showing finned tubing.

The finned tubing 67 comprises a length of tube having a multiplicity of heat transfer elements or fins 77 thereon spaced at intervals (e.g., one fin diameter) along the tubing. As shown in FIG. 4, each fin 77 is annular in shape and generally coaxial with the finned tubing 67. The diameter of each fin 77 is preferably at least twice as large as the diameter of the finned tubing 67 for maximizing heat transfer from the gases of combustion flowing through the annular space 53 to the solution carried by tubing. By way of example, the finned tubing 67 may have an outside diameter of 0.84 in. and the annular fins 77 may have an outside diameter of 1.86 in. These dimensions, and the shape of the heat transfer fins 77, may vary without departing from the scope of this invention. Preferably, the fins 77 should have a tight or close fit inside the annular space, so that each fin is touching or almost touching opposing walls of the casing 31 and the heat shield 47. This arrangement further enhances heat transfer from the hot gases to the liquid inside the heating coil 63. Finned tubing 67 useful in the design of this invention is commercially available from ESCOA/TEMPCO of Pryor, Okla.

The casing 31 has an exhaust opening 79 therein for receiving an exhaust stack 81 which communicates with the annular space 53 adjacent the left end wall 33 of the casing 31. In FIG. 2, the exhaust opening 79 is located within the side wall 37. It is contemplated, however, that the exhaust stack 81 may extend through an opening in the left end wall 33 rather than the side wall 37 and remain within the scope of this invention. The hot gases of combustion exit the casing 31 through this exhaust stack 81.

To operate the pressure washer 1, the pump motor 21 is turned on and the spray wand 25 is actuated to deliver an even spray pattern. The burner 57 is then actuated to discharge a flaming mix of air and fuel into the combustion chamber 55 in a direction toward the right end wall 35 of the casing 31. As combustion occurs in the combustion chamber 55, the heat shield 47 protects the finned tubing 67 against the high temperatures in the chamber, which temperatures would otherwise damage the sensitive fins 77 on the tubing. The heat shield 47 directs the hot gases of combustion toward the refractory lining 44 of the right end wall 35 of the casing 31, which functions to deflect the gases either back into the combustion chamber to insure complete combustion or to flow between the winds of the unfinned tubing 65 and toward the annular space 53.unfinned tubing 65 between the winds of unfinned tubing 65, heat is transferred (by radiation and convection) to the tubing and the cleaning liquid contained therein, and the temperature of the gases decreases. A sufficient number of winds of unfinned tubing 65 should be used to ensure that the temperature of the gas drops to an acceptable level before contacting the finned tubing 67. This temperature is preferably less than about 1100 degrees F.

As the gases move through the annular space 53 past the finned tubing 67, the heat transfer fins 77 on the tubing extract additional heat from the gases for transfer to the cleaning solution. The heat transfer from the gas to the fins 77 is primarily by convection. The use of heat transfer fins 77 greatly enhances the heat transfer efficiency of the system compared to conventional pressure washer designs. The hot gases exit the annular space 53 via the exhaust stack 81.

As hot gas flows from the combustion chamber 55 toward, into and through the annular space 53 for eventual exit through the exhaust stack 81, pressurized cleaning fluid flows through the heating coil 63 in a direction generally opposite to the direction of gas flow. This is beneficial in that the relatively cool (e.g., 60 degrees F.) liquid entering the casing 31 and flowing through the finned tubing 67 is preheated by the gas flowing through the annular space 53. As a result, by the time the liquid enters the unfinned tubing 65, it has an elevated temperature which is further increased because the unfinned tubing is exposed to the hotter gases immediately adjacent the combustion chamber 55. And finally, as the heated liquid flows through the outlet line 71, it is subjected to the highest temperatures in the combustion chamber 55 which serves to heat the liquid to its final temperature (e.g., 200 degrees F.). The difference between the temperature of the liquid at the inlet 69 of the coil 63 and the temperature at the outlet 71 of the coil may be, for example, 140 degrees F.

It will be observed from the foregoing that the transfer characteristics of the heat exchanger 23 of the present invention represent an improvement over conventional designs. As a result of the efficiencies of this system, more cleaning solution can be heated to higher temperatures using less fuel. Also, the stack (exhaust) 81 temperatures are reduced since more heat is extracted from the gas by the fins 77, and there is less risk of creating a "cold" combustion chamber 55. Further, because finned tubing 67 can be used, the overall length of tubing required is reduced, which results in less complexity and cost.

The heat exchanger 23 described above is also easy to construct. The heating coil 63 is simply formed on a mandrel having a diameter corresponding to that of the heat shield 47, after which the coil is mounted on the heat shield and secured thereto by welding or fastening the first wind of unfinned tubing 65 proximate the heat shield to the outer surface of the heat shield. At least one heat shield connector 93 is secured between the inlet 69 and the heat shield 47 to hold the heat shield in place. The three layers 41, 43, 45 forming the side wall 37 of the casing 31 may be assembled as a unit and then slidably moved as a unit into position around the heating coil 63 on the heat shield 47. This is the preferred method if assembly takes place in the field. For factory assembly, the side wall 37 and right end wall 35 may be installed in stages. First, the inner wrapper 43 is wrapped around the heating coil 63 and secured (e.g., spot welded) to itself along a lap seam. Wind connectors are secured between the inner steel wrapper 43 of the side wall 37 and winds of unfinned tubing 65. Second, the layer of insulation 41 is wrapped around the inner steel wrapper 43 and secured in place by using tape or the like. The left end wall 33 is secured to the side wall 37 and the burner is inserted through the end wall and secured in place. The outer steel wrappers 40, 45 of the right end wall 35 and side wall 37, respectively, are integrally formed. The refractory lining 44 is mounted to the inner surface of the outer steel wrapper 45 of the right end wall 35. Finally, the coil assembly comprising the coil 63, heat shield 47, inner steel wrapper 43, insulation 41, left end wall 33 and burner is inserted into the outer steel wrapper assembly comprising the outer steel wrappers 40, 45 to complete the assembly of the heat exchanger.

The dimensions of the heat exchanger 47, size of tubing, etc. will vary depending on water flow and temperature requirements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A high pressure washer comprising a heat exchanger for heating a cleaning fluid, and a dispenser for dispensing heated cleaning fluid under pressure onto a surface to clean it, said heat exchanger comprising a casing having first and second end walls and a tubular sidewall extending therebetween along a central longitudinal axis, a tubular heat shield inside the casing having a first end adjacent the first end wall of the casing and a second end spaced from the second end wall of the casing to define a gap therebetween, said heat shield having an inner surface defining a combustion chamber within the casing, and an outer surface, a burner adjacent the first end wall of the casing for discharging flames and hot combustion gases into the combustion chamber, an annular space between the outer surface of the heat shield and the casing, a heating coil inside the casing extending longitudinally with respect to the casing for containing cleaning fluid to be heated, said heating coil comprising a length of unfinned tubing disposed in the gap between the second end of the heat shield and the second end wall of the casing, and a length of finned tubing in said annular space between the heat shield and the casing, said burner being operable to emit flame and hot gases of combustion into said combustion chamber in a direction toward said second end wall, said heat shield serving to protect the finned tubing by directing the hot gases of combustion for contact first with said unfinned tubing, resulting in cooling of the gases, followed by contact with the finned tubing in said annular space, thereby enhancing the heat transfer between the gases and the fluid contained within the heating coil.

2. A pressure washer as set forth in claim 1 wherein said length of unfinned tubing comprises a plurality of winds of unfinned tubing, said winds being spaced from one another to permit the flow of hot combustion gases therebetween.

3. A pressure washer as set forth in claim 2 wherein said finned tubing comprises tubing having a multiplicity of heat transfer fins thereon spaced at intervals along the tubing, each heat transfer fin encircling the tubing and being coaxial therewith.

4. A pressure washer as set forth in claim 3 wherein said heat transfer fins are generally annular in shape and have a close fit within said annular space so that said fins substantially contact the heat shield and the casing.

5. A pressure washer as set forth in claim 3 wherein the heating coil has an inlet connected to the finned tubing for flow of cleaning fluid into the finned tubing and an outlet connected to the unfinned tubing for flow of heated cleaning fluid out of the unfinned tubing for delivery to said dispenser, the finned tubing promoting heat transfer to the cleaning fluid to pre-heat the cleaning fluid before the fluid flows through the unfinned tubing.

6. A pressure washer as set forth in claim 5 wherein the outlet extends longitudinally within the combustion chamber in closely spaced relationship with the inner surface of the heat shield such that the outlet is exposed to the hot combustion gases to promote additional heat transfer between the hot gases and the heated cleaning fluid flowing through the outlet prior to delivery to the dispenser.

7. A pressure washer as set forth in claim 5 wherein said casing, heat shield and heating coil are generally coaxial.

8. A pressure washer as set forth in claim 7 wherein said burner extends through an opening in the first end wall of the casing.

9. A pressure washer as set forth in claim 5 wherein said casing has an exhaust opening therein communicating with said annular space for exhausting combustion gases out of the casing, said exhaust opening being located adjacent the first end wall of the casing.

10. A pressure washer as set forth in claim 9 wherein said heat shield and burner are sized so that flame emitted by the burner does not contact the heat shield.

11. A pressure washer as set forth in claim 10 wherein the number of winds of unfinned tubing is more than twice as great as the number of winds of finned tubing.

12. For use in a pressure washer, a heat exchanger for heating a cleaning fluid, said heat exchanger comprising a casing having first and second end walls and a tubular sidewall extending therebetween along a central longitudinal axis, a tubular heat shield inside the casing having a first end adjacent the first end wall of the casing and a second end spaced from the second end wall of the casing to define a gap therebetween, said heat shield having an inner surface defining a combustion chamber within the casing, and an outer surface, a burner adjacent the first end wall of the casing for discharging flames and hot combustion gases into the combustion chamber, an annular space between the outer surface of the heat shield and the casing, a heating coil inside the casing extending longitudinally with respect to the casing for containing cleaning fluid to be heated, said heating coil comprising a length of unfinned tubing disposed in the gap between the second end of the heat shield and the second end wall of the casing, and a length of finned tubing in said annular space between the heat shield and the casing, said burner being operable to emit flame and hot gases of combustion into said combustion chamber in a direction toward said second end wall, said heat shield serving to protect the finned tubing by directing the hot gases of combustion for contact first with said unfinned tubing, resulting in cooling of the gases, followed by contact with the finned tubing in said annular space, thereby enhancing the heat transfer between the gases and the fluid contained within the heating coil.

13. A heat exchanger for use in a pressure washer as set forth in claim 12 wherein said length of unfinned tubing comprises a plurality of winds of unfinned tubing, said winds being spaced from one another to permit the flow of hot combustion gases therebetween.

14. A heat exchanger for use in a pressure washer as set forth in claim 13 wherein said finned tubing comprises tubing having a multiplicity of heat transfer fins thereon spaced at intervals along the tubing, each heat transfer fin encircling the tubing and being coaxial therewith.

15. A heat exchanger for use in a pressure washer as set forth in claim 14 wherein said heat transfer fins are generally annular in shape and have a close fit within said annular space so that said fins substantially contact the heat shield and the casing.

16. A heat exchanger for use in a pressure washer as set forth in claim 14 wherein the heating coil has an inlet connected to the finned tubing for flow of cleaning fluid into the finned tubing and an outlet connected to the unfinned tubing for flow of heated cleaning fluid out of the unfinned tubing, the finned tubing promoting heat transfer to the cleaning fluid to pre-heat the cleaning fluid before the fluid flows through the unfinned tubing.

17. A heat exchanger for use in a pressure washer as set forth in claim 16 wherein the outlet extends longitudinally within the combustion chamber in closely spaced relationship with the inner surface of the heat shield such that the outlet is exposed to the hot combustion gases to promote additional heat transfer between the hot gases and the heated cleaning fluid flowing through the outlet.

18. A heat exchanger for use in a pressure washer as set forth in claim 16 wherein said casing has an exhaust opening therein communicating with said annular space for exhausting combustion gases out of the casing, said exhaust opening being located adjacent the first end wall of the casing.

19. A heat exchanger for use in a pressure washer as set forth in claim 18 wherein said heat shield and burner are sized so that flame emitted by the burner does not contact the heat shield.

20. A heat exchanger for use in a pressure washer as set forth in claim 19 wherein the number of winds of unfinned tubing is more than twice as great as the number of winds of finned tubing.

* * * * *